US005555975A

United States Patent [19]

Smith

[11] Patent Number: 5,555,975

[45] Date of Patent: Sep. 17, 1996

[54] SHIPPING CONTAINER CONVERTIBLE INTO DISPLAY STAND

[75] Inventor: Michael J. Smith, Orangeburg, N.Y.

[73] Assignee: Arrow Art Finishers, Inc., Bronx, N.Y.

[21] Appl. No.: 339,952

[22] Filed: Nov. 15, 1994

[51] Int. Cl.[6] ..... B65D 5/50

[52] U.S. Cl. ..... 206/762; 206/45.24; 206/805; 248/174

[58] Field of Search ..... 206/44 R, 44.11, 206/44 B, 45.11, 45.24, 805; 211/132; 248/174

[56] References Cited

U.S. PATENT DOCUMENTS

| | | | |
|---|---|---|---|
| 2,137,420 | 11/1938 | Soybel | 206/44 R |
| 2,147,135 | 2/1939 | Addis et al. | 206/44 R |
| 4,582,283 | 4/1986 | Schmitt | 206/44 R |
| 4,583,705 | 4/1986 | Schmitt | 206/44 R |
| 4,619,426 | 10/1986 | Drueck, Jr. | 206/805 |
| 4,726,476 | 2/1988 | Smith | 206/45.24 |
| 4,938,343 | 7/1990 | Willis | 206/44 R |

FOREIGN PATENT DOCUMENTS

| | | | |
|---|---|---|---|
| 1312374 | 4/1973 | United Kingdom | 206/44 R |

*Primary Examiner*—David T. Fidei
*Attorney, Agent, or Firm*—Kirschstein, et al.

[57] ABSTRACT

A convertible shipping container includes, as its main components, a tray-shaped receptacle for accommodating objects to be shipped in the container in its collapsed condition and displayed in the container in its erected condition, a base connected to the receptacle for displacement between its collapsed position in which it is flat and substantially coextensive with a bottom wall of the receptacle and an erected position in which it has a substantially box-shaped configuration. A securing arrangement, especially such constituted by a tray-shaped cover, secures the base in its collapsed position to the receptacle prior to conversion of the shipping container into a display stand. A lid closes the open end of the receptacle to hold the objects within the receptacle prior to and during the conversion and supports the weight of the receptacle and its contents from below while the base is being displaced from its collapsed to its erected position with the lid resting on a support surface and the bottom wall of the receptacle facing upwardly.

8 Claims, 4 Drawing Sheets

FIG.4
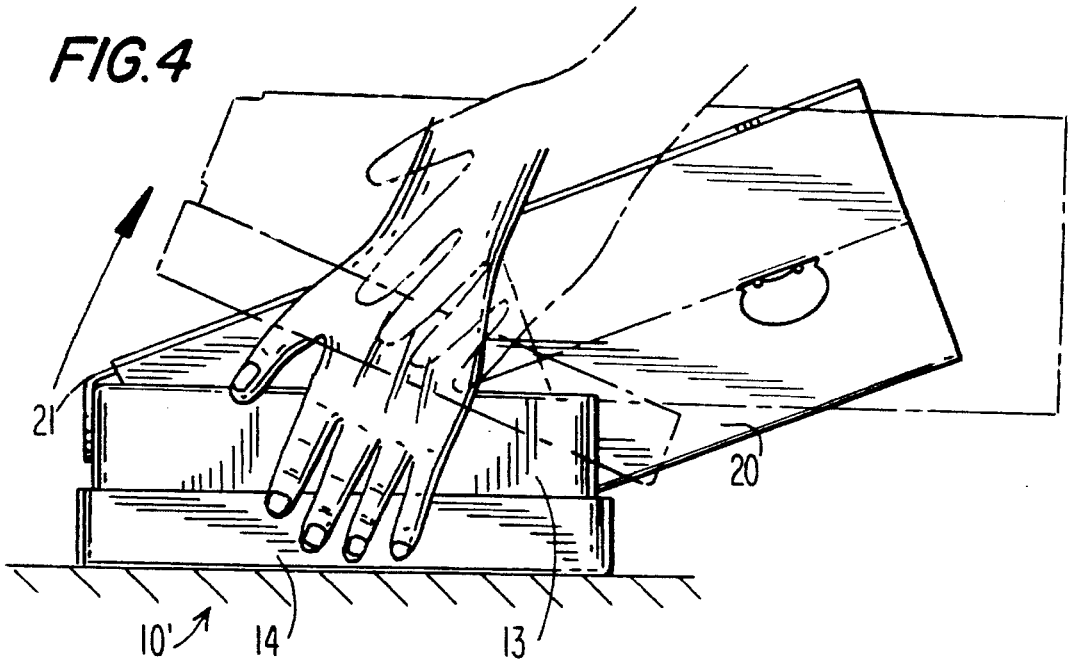
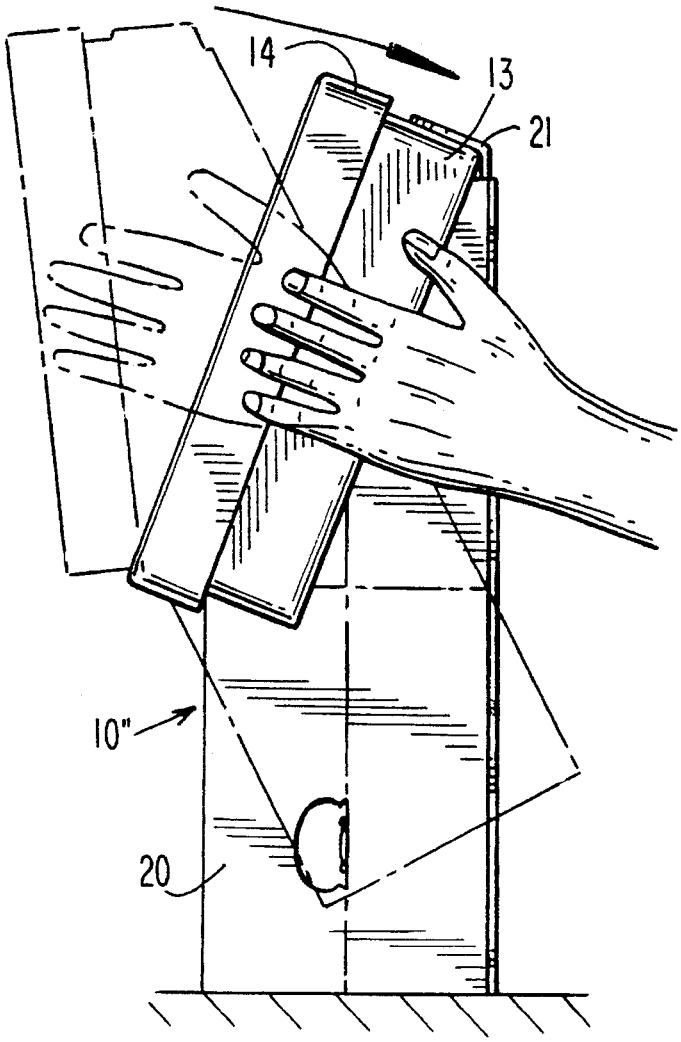
FIG.5

SHIPPING CONTAINER CONVERTIBLE INTO DISPLAY STAND

BACKGROUND OF THE INVENTION

1. Field of the Invention

The present invention relates to shipping and displaying goods in general, and more particularly to a shipping container convertible into a display stand while keeping the shipped goods therein for display.

2. Description of the Related Art

There are already known various constructions and configurations of shipping containers, among them such that are equipped for eventual use as display containers for displaying the goods shipped therein after the container has reached its destination, such as a retail store. One example of a shipping container of this kind is disclosed in a commonly owned U.S. Pat. No. 4,726,476. The shipping container depicted there includes a tray-shaped receptacle that actually receives the goods to be initially shipped and eventually displayed, not only during storage and shipping, but also during the display, as well as a base or stand structure that is fixedly connected to the tray-shaped receptacle, is collapsed and/or folded against the receptacle prior to, during and after the shipping, and is unfolded or erected when the container is to be used for displaying the goods.

As advantageous as this arrangement may be in some respects or for some purposes, it also has certain drawbacks that make it difficult or impossible to use it under certain circumstances, especially when the goods contained in the receptacle are individually or cumulatively quite heavy. More particularly, in this shipping arrangement, the receptacle maintains the base structure in its collapsed condition. This means that the receptacle must be lifted, despite its often considerable weight, before the base structure is free to unfold into its erected position. Now, experience has shown that, even when measures are taken to bring about automatic unfolding of the base structure once released, the unfolding process is not always successful or complete, be it because some parts of the base structure interfere with each other's relative movements, because the biasing means that urges the base structure to its erected position is partly or fully ineffective for some reason, or because of improper handling of the shipping container by the store personnel during the erection process that may cause frictional retention of certain parts of the base structure due to contact thereof with the store floor or the like. The main cause of the latter situation is often the very weight of the full shipping container which may cause the store personnel to fail to lift the receptacle sufficiently, or even at least temporarily lose balance.

Of course, if it were attempted to support the receptacle on such incompletely erected base structure, the latter might buckle or collapse under the weight of the full container, or the entire assembly may topple, with attendant damage to the goods and/or injury to the personnel or any store patrons who may be nearby either during the erection process, or even later should the personnel fail to notice the incomplete unfolding before leaving.

In view of such undesirable consequences, it is imperative that the person putting the goods on display make sure that the base structure is completely unfolded before lowering the receptacle. This typically means that the strain stemming from having to handle the rather heavy full receptacle is further aggravated by having to either jiggle or otherwise manipulate or maneuver the heavy receptacle to free any stuck parts of the base structure for continued movement to their erected positions, or precariously hold the receptacle in such a manner as to free one hand and use the latter to manually perform or complete the movement of the affected base structure parts to their erected positions. In either event, such operation is rather cumbersome and involves a considerable amount of physical stress on the part of, and/or increased danger of injury to, the involved personnel.

Similar convertible display stand arrangements are also known from the U.S. Pat. No. 4,813,536 and from the French Patent No. 84 04211. Yet, even the arrangements disclosed in these patents possess the same or similar disadvantages as discussed above, and do not lend themselves to being erected without the store personnel incurring substantial physical effort in the process.

OBJECTS OF THE INVENTION

Accordingly, it is a general object of the present invention to avoid the disadvantages of the prior art.

More particularly, it is an object of the present invention to provide a convertible shipping container for goods to be displayed at their destination, which container does not possess the drawbacks of the known containers of this type.

Still another object of the present invention is to devise a shipping container of the type here under consideration which can be converted into a fully erected display container containing the goods prior to lifting the goods receptacle off the ground.

It is yet another object of the present invention to design the above container in such a manner as to be highly immune to damage while in transit and yet easily convertible into the display container at the final destination.

A concomitant object of the present invention is so to construct the convertible container of the above type as to be relatively simple in construction, inexpensive to manufacture, easy to use, and reliable in operation nevertheless.

SUMMARY OF THE INVENTION

In keeping with the above objects and others which will become apparent hereafter, one feature of the present invention resides in a convertible shipping container which includes as one of its components a tray-shaped receptacle for accommodating objects to be shipped in the container in its collapsed condition and displayed in the container in its erected condition. The receptacle includes a bottom wall and a plurality of circumferential walls bounding an open end of the receptacle. There is further provided a base that includes a plurality of walls and is connected to the receptacle for displacement between its collapsed position in which the base is flat and its walls are substantially coextensive with the bottom wall of the receptacle, and an erected position in which the walls extend along courses that give the base a substantially box-shaped configuration. The container further includes means for securing the base in its collapsed position to the receptacle prior to conversion of the shipping container into a display stand, and a lid for closing the open end of the receptacle to hold the objects within the receptacle prior to and during the conversion, with the lid supporting the weight of the receptacle and its contents from below while the base is being displaced from its collapsed to its erected position with the lid resting on a support surface and the bottom wall of the receptacle facing upwardly and being removable from the receptacle following reorientation of the container into its final position in which the receptacle is situated on top of the base which is then in its fully erected condition.

A particular advantage of the convertible shipping container as described so far is that the container need not be held at a distance from the ground or similar support while the base is being erected; rather, the construction and configuration of the receptacle is such as to encourage, if not make mandatory, the resting of the container on the support with the bottom wall facing up while the base is being erected, thus freeing the hands of the person handling the container for manipulating the base, if need be, towards its fully erect position and, even more importantly, relieving such person of the otherwise existing burden and physical strain of having to hold the not insubstantial weight of the full container as the base unfolds.

According to another aspect of the present invention, the base includes at least two sections that are hinged to one another for folding on top of one another adjacent to the bottom wall of the receptacle in the collapsed condition of the base, and to form substantially aligned extensions of one another in the erected condition of the base. This makes it possible to make the base twice if not more times higher than what would correspond to the corresponding dimension of the tray-shaped receptacle, thus bringing the objects or goods on display more into the normal visual range of a prospective buyer of such goods.

It is also advantageous when the securing means includes a tray-shaped cover that confines the base in the collapsed condition thereof between itself and the bottom wall of the receptacle and complements the lid when assembled therewith to form an outer shipping box. This brings about the advantages of simplicity of construction, and of an uncomplicated outer shape of the shipping container in its shipping condition coupled with enhanced protection of the goods being shipped due to their confinement both in the inner receptacle and the outer box.

The convertible shipping container of the present invention advantageously further includes a protective panel situated in a shipping position thereof at the open end of the receptacle between the lid and the objects contained in the receptacle. This protective panel, which provides additional protection for the goods during shipment, is advantageously hinged to the receptacle for movement from its shipping position into another position in which it reveals the objects contained in the receptacle. It is especially advantageous when the protective panel is provided at least on that of its major surfaces which faces the passerby in the other position of the protective panel with informational matter relating to the objects on display.

In accordance with another facet of the present invention, the plurality of walls that constitute the base include a front wall, a back wall and two side walls, all as considered in the final position of the container. Each of the side walls interconnects the front wall with the back wall and includes two substantially identical parts which are hinged to one another at a crease line for folding of the side wall parts on top of one another and as substantially aligned continuations of the front and back walls, respectively, in the collapsed condition of the base. Then, the convertible shipping container advantageously further includes means for urging the plurality of walls constituting the base toward their erected positions. Such urging means advantageously includes at least one resilient element connected to the side walls of the base and pulling the same toward one another with a force that diminishes as the base approaches its erected condition.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 4 is a side elevational view of the convertible container in its erected condition of FIG. 3, but additionally showing an initial phase of a reorientation of the container into its display position;

FIG. 5 is a view akin to that of FIG. 4, but showing the terminal phase of the reorientation process;

DETAILED DESCRIPTION OF THE PREFERRED EMBODIMENT

Figure 1:
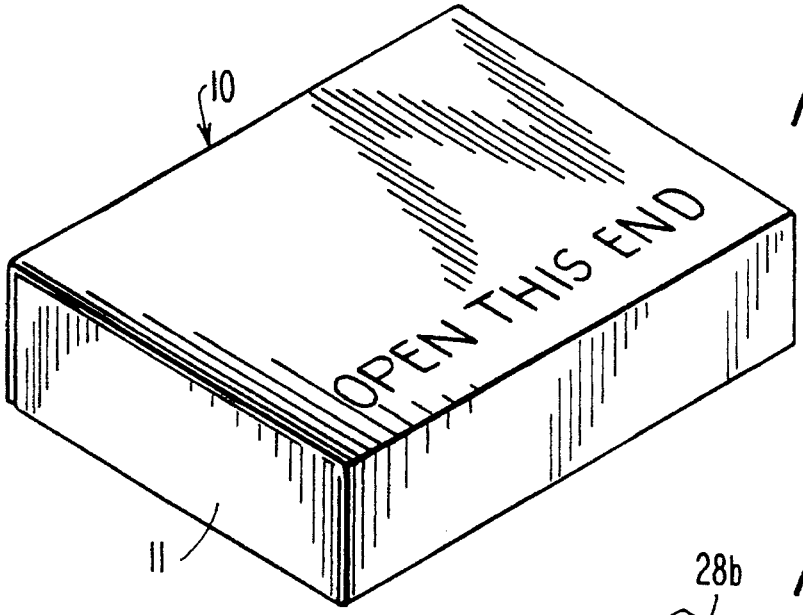
FIG. 1 is a perspective view from above of a convertible shipping container of the present invention in its fully assembled collapsed condition.
Figure 2:
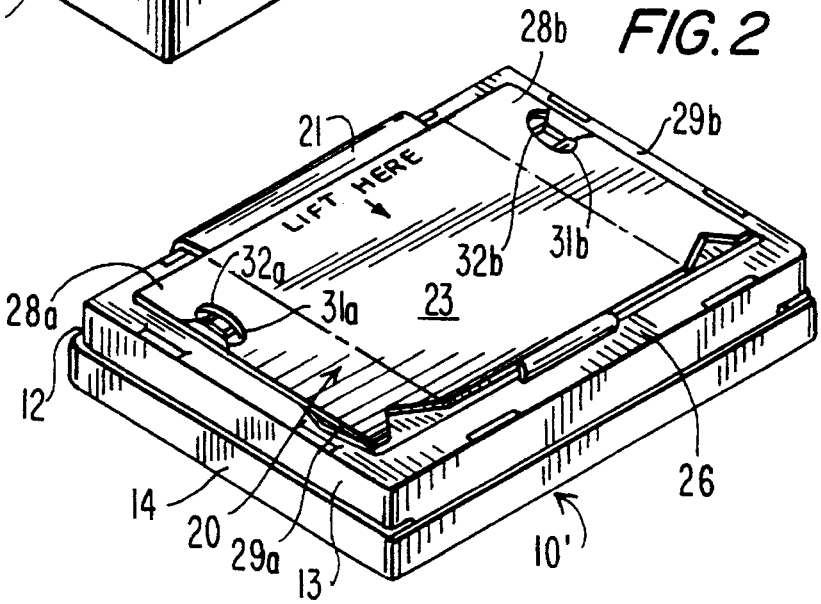
FIG. 2 is a view similar to that of FIG. 1 but upon partial disassembly of the container by removing a cover therefrom to expose a collapsed base, in a base erecting position thereof.

Referring now to the drawing in detail, and first to FIGS. 1 and 2 thereof, it may be seen that the reference numeral 10 has been used therein to identify a convertible shipping container in accordance with the present invention in its entirety. As depicted in FIG. 1, the container 10 is not much different from ordinary shipping containers, except possibly that it carries on its cover 11 an advisory to the recipient to start opening the container 10 by removing the cover 11 first. It stands to reason that a person trying to follow that advice will naturally place the container 10 on the floor or other support such that the cover 11 is located on top.

However, once the cover 11 is removed from the rest of the container 10, leaving a remainder 10' behind, it immediately becomes apparent that the shipping container 10 is not an ordinary shipping container but rather one that is designed to function as a display stand for the articles or goods that have been shipped within the container 10. This is so because the removal of the cover 11 reveals the presence of a collapsible base 20, whether the latter remains in its folded or collapsed condition of FIG. 2, or automatically "pops up" toward or into its unfolded or erected position presented in FIG. 3, toward which it is urged by resilient urging means 12, such as a pair of rubber bands or similar resilient endless elements as shown.

A flexible hinge portion or flap 21 is shown to connect the collapsible base 20 to a goods-accommodating tray 13 that constitutes another component of the container 10. The flexible hinge flap 21, which is shown to be actually an integral portion of what becomes an upper wall 22 of the base 10 in the erected position illustrated in FIG. 3, not only prevents dissociation of the base 20 from the tray 13 after the cover 11 is removed, but also keeps the base 20 properly aligned with respect to the tray 13 as the base 20 unfolds with attendant pivoting of the upper wall 22 about the hinge portion 21 and thereafter, so that only a minimum amount of adjustment, if any, is necessary to bring the base 20 in its desired final position with respect to the tray 13.

As will become more readily apparent as the description of the drawing proceeds, the tray 13 is actually in its "bottoms up" position during the base unfolding process, that is, in its position in which its opening faces downwardly. This means that the goods contained in the tray 13 would fall out of the tray 13, were it not for the provision in accordance with the present invention of a removable lid 14 that prevents this from happening prior to the removal of the cover 11 when the lid 13 and the cover 11 complement themselves into an external shipping box, and thereafter. This is so because in the position of FIGS. 1 to 3, the lid 14 is disposed underneath the tray 13 so that the lid 14 directly or indirectly supports the weight of the tray 13 proper and of the goods contained therein, so that actually an extensive deliberate action on the part of the user would be required even after the removal of the cover 11 before the goods would end up on the store floor or similar support.

It will be appreciated that, due to the fact that the container 10 rests on the respective support via its lid 14 as the opening of the container 10 and unfolding of the base 20 progresses, the store personnel can perform or aid in the base erection process, if need be, with only a small fraction of the effort that is required for the same action in the prior art arrangements described above. More particularly, the personnel is free to get involved to the extent necessary in the displacement of the initially folded-over ultimately bottom section 23 of the base 20 about a crease line 24 that joins the bottom section 23 to a top section 25 of the base 20, in the movement apart and/or erection of the upper wall 22, a lower wall 27 and two side walls 28*a* and 28*b* that were initially folded over in the collapsed base 20 about respective crease lines 29*a* and 29*b*, and in straightening out of the side walls 29*a* and 29*b*. To aid in this endeavor, the upper wall 22 is provided with a gripping cutout 30, and the side walls 28*a* and 28*b* are provided with respective cutouts 31*a* and 31*b*, of which the person trying to help or cause the base 20 to reach its fully erected state may avail himself or herself to facilitate the displacement of the affected ones of the walls 22, 28*a* and 28*b*.

Figure 3:
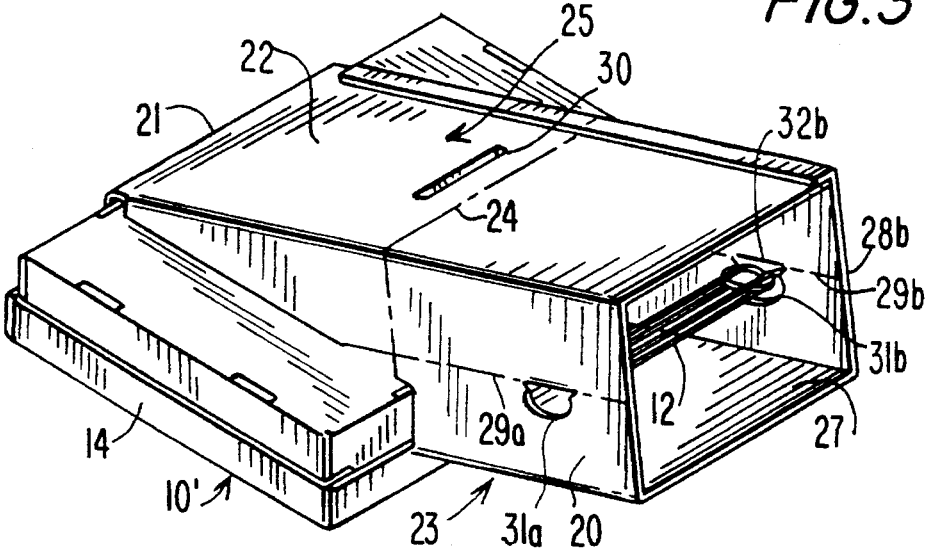
FIG. 3 is a view identical to that of FIG. 2 but with the base in its fully erected condition.

It will be understood that the above-discussed base unfolding process can be performed completely manually, that is, without the aid of the resilient urging means 12 should the latter not be provided in the first place, or become ineffective later, such as by becoming disengaged from the base 20 during transportation or other manipulation with the container 10. Yet, it is often preferred to make as much of this process as possible automatic by utilizing the action of the resilient means 12 on the base 10. To this end, as shown in FIG. 3 of the drawing, respective portions 32*b* and 32*a* (which latter is not visible in the drawing) of the side walls 28*a* and 28*b*, which are obtained as a result of making the cutouts 31*a* and 31*b* in the respective side walls 28*a* and 28*a*, are used as regions of attachment of the resilient urging means 12 to the respective side walls 28*a* and 28*b*. As a comparison of FIGS. 2 and 3 will reveal, the portions 32*a* and 32*b* are situated in or close to the respective cutouts 31*a* and 31*b* in the situation illustrated in FIG. 2 in which the side walls 28*a* and 28*a* are located outwardly of the wall 22 and are substantially coplanar therewith, and extend substantially normal to the respective side walls 28*a* and 28*b* in the condition of the base 10 that is depicted in FIG. 3, with the rubber bands or similar urging means 29 being in engagement with both of the portions 32*a* and 32*b* in both instances. It should be self-evident that, inasmuch as the portions 32*a* and 32*b* are farthest apart in FIG. 2 and closest to each other in FIG. 3, the forces exerted by the urging means 12 on the side walls 28*a* and 28*b* in the former case by far exceed those encountered in the latter case, to the point that such forces are at or close to zero in the position of FIG. 3 so as not to cause the side walls 28*a* and 28*b* to unduly buckle inward.

In accordance with the present invention, it is only after the completion of this base unfolding operation that the weight of a remainder 10' (i.e. what is left after the initial removal of the cover 11) of the container 10 and of its contents has to be lifted. By that time, however, the personnel has become satisfied that the base 20 is in its fully unfolded condition, so that no further manipulation of such remainder 10' for base unfolding purposes is necessary. Therefore, the lifting and display stand erection process that is depicted in FIGS. 4 and 5 of the drawing, can be accomplished in a short period of time, thus minimizing the physical strain on the personnel. This process begins with the store clerk or similar person using his or her hands to first engage at least the lid 14 but advantageously also the tray 13 from both sides. Then, such person lifts the remainder 10' of the container 10 first as indicated by an arrow in FIG. 4 into an intermediate position illustrated there in dash-dotted lines, and then through another intermediate position shown in FIG. 5 in dash-dotted lines as indicated by another arrow ultimately into its final position shown there in solid lines. Of course, care must be taken that the lid 14 not dissociate itself or fall off the tray 13, lest the articles or goods contained in the tray 13 fall out. That is why it is best to predominantly if not exclusively hold the remainder 10' of the container 10 by the lid 14 during this display stand erection operation. Of course, once it reaches its final position, the thus erected stand 10" already rests on the floor in its display position, that is, with the tray 13 (still covered by the lid 14) on top of the base 20, thus relieving the above person of the burden of supporting the weight of the remainder 10' and its contents.

Figure 6:
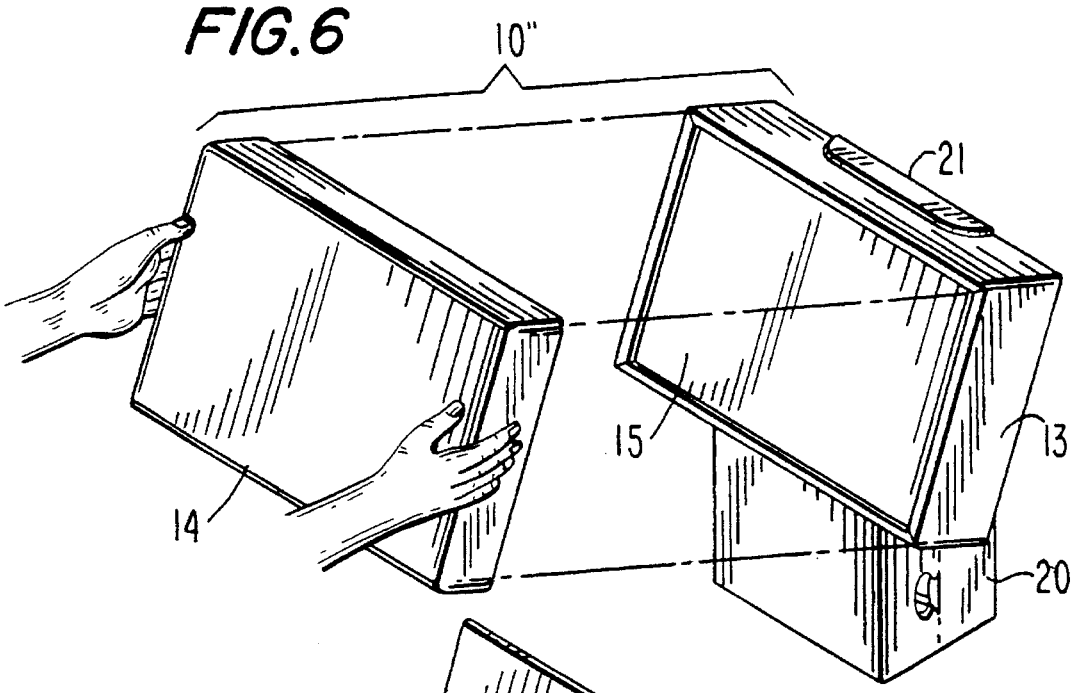
FIG. 6 is a front perspective view of the reoriented container, further indicating the removal of a lid in the process of uncovering the goods to be displayed.
Figure 7:
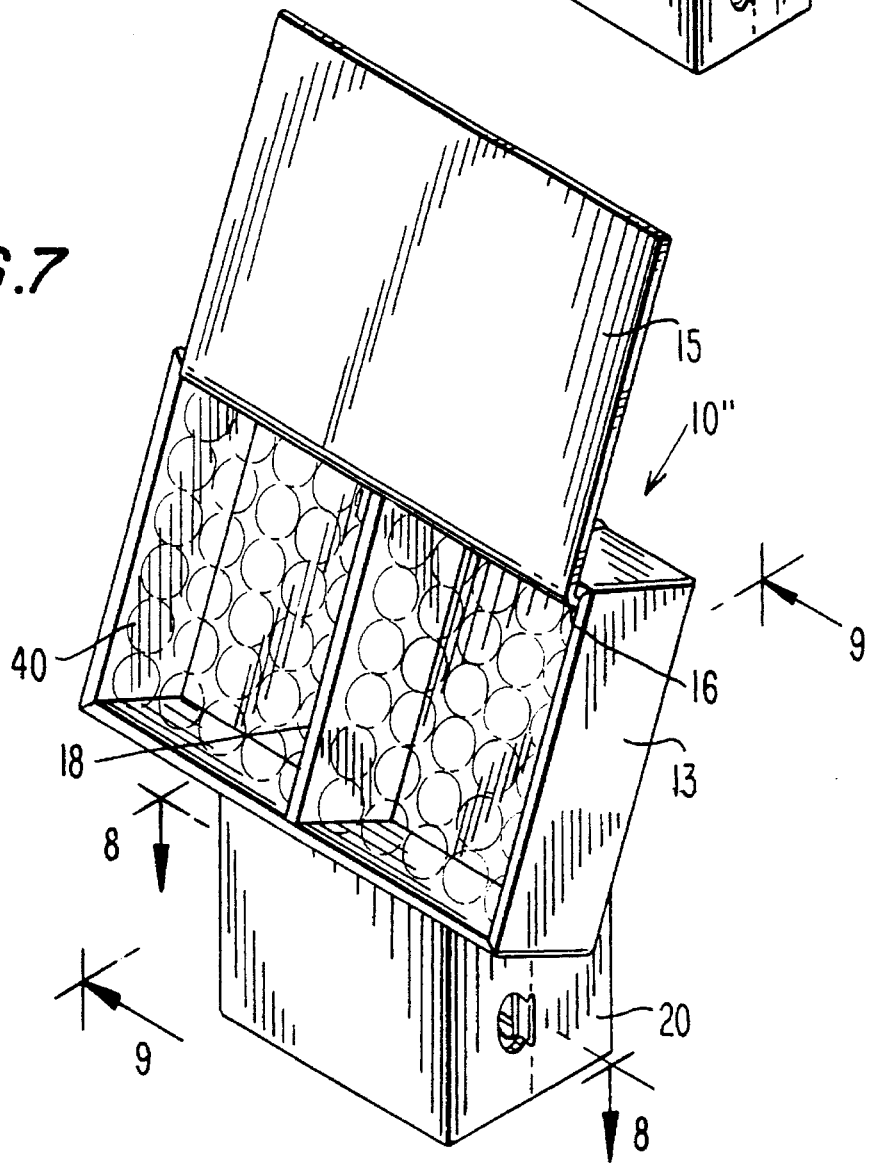
FIG. 7 is a view corresponding to that of FIG. 6 but taken after the completion of the uncovering operation by pivoting a covering panel to reveal the goods previously obscured by it.

After that, it is easy to remove the lid 14 from the tray in the manner depicted in FIG. 6 of the drawing. In the illustrated embodiment of the present invention, this lid removal reveals a panel 15 which, as shown especially in FIG. 7, is hinged to the tray 13 for pivoting about a hinging portion 16 between its storage and shipping position of FIG. 6 in which it covers up the contents of the tray 13 providing additional confinement thereof and protection therefor, and its display position of FIG. 7 in which it not only reveals respective items, articles or goods such as cans 40 to be displayed, but also attracts customers' attention thereto when it is provided, as contemplated, with appropriate advertising or other informational matter (not shown) relating to such items 40 on at least that one of its surfaces that faces the passerby when the panel assumes its display position. At least one partitioning wall 18 may be provided in the tray 13 to separate groups of the items 40, or even individual ones of such items 40, from one another.

Figure 8:
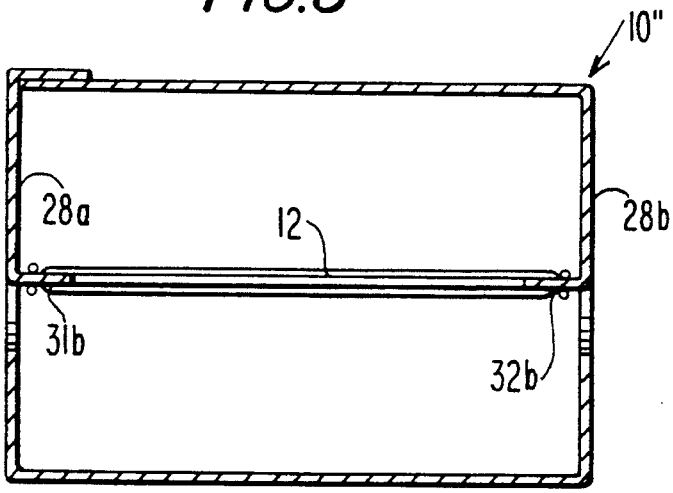
FIG. 8 is a cross-sectional view taken on line 8—8 of FIG. 7.
Figure 9:
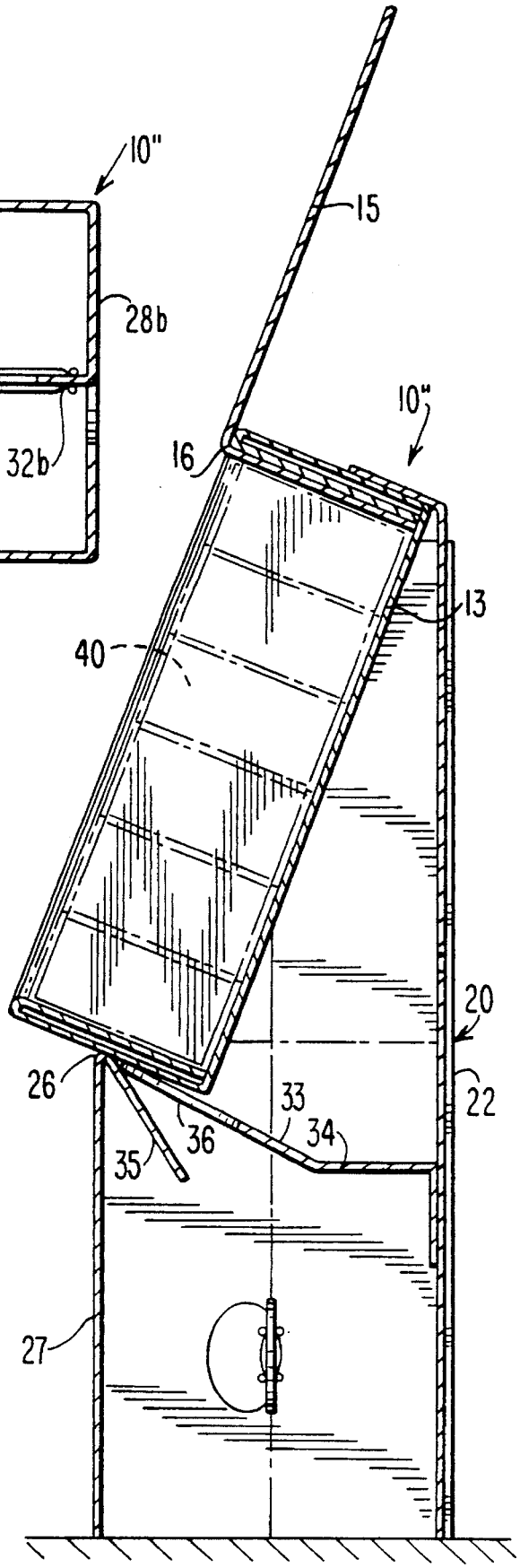
FIG. 9 is a vertical sectional view taken on line 9—9 of FIG. 7.

FIG. 8 of the drawing reveals in additional detail how the rubber bands or similar urging means 12 urge the side walls 28*a* and 28*b* towards their substantially planar erected positions by acting on the projecting portions 32*a* and 32*b* thereof, whereas FIG. 9 of the drawing, besides showing in detail of what layers the various walls of the display stand 10" consist, reveals that a portion 33 of the "lower" (now front) wall 27 of the base 20 is connected to the "upper" (now back) wall 22 to provide additional internal reinforcement for the base 20. The wall portion 33 is foldable about a folding line 34 and is hingedly connected with the remainder of the front wall 27 by an additional hinge portion 26 to enable it to assume its folded position alongside the walls 22 and 27 in the collapsed condition of the base 20. The tray 13 is shown in FIG. 9 to rest on the hinge portion 26 substantially midway its then lower wall. A flap 35 cut out of the wall portion 33, and an associated complementary cutout 36, are instrumental in ensuring good retention of the tray 13 in its illustrated position relative to the base 20.

It will be understood that each of the elements described above, or two or more together, may also find a useful application in other types of constructions differing from the type described above.

While the present invention has been described and illustrated herein as embodied in a specific construction of a shipping container that is convertible into a display stand for the goods contained therein, it is not limited to the details of this particular construction, since various modifications and structural changes may be made without departing from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalents of the following claims.

What is claimed as new and desired to be protected by Letters Patent is set forth in the appended claims.

1. A convertible shipping container comprising:

a) a tray-shaped receptacle for accommodating objects to be shipped in the container in its collapsed condition and displayed in the container in its erected condition, said receptacle including a bottom wall and a plurality of circumferential receptacle walls bounding an open end of said receptacle;

b) a base including a plurality of base walls and connected to said receptacle for displacement between a collapsed position thereof in which said base is flat and said base walls are substantially coextensive with said bottom wall of said receptacle, and an erected position in which said base walls extend along courses that give said base a substantially box-shaped configuration;

c) a tray-shaped cover for securing said base in said collapsed position thereof to said receptacle prior to conversion of the shipping container into a display stand, said cover having a confining wall for confining said base in said collapsed condition thereof between said confining wall and said bottom wall of said receptacle, and a plurality of cover skirt walls surrounding and extending perpendicularly away from said confining wall;

d) a tray-shaped lid for closing said open end of said receptacle to hold the objects within the receptacle prior to and during said conversion, said lid having a lid support wall for supporting the weight of said receptacle and its contents from below while said base is being displaced from its collapsed to its erected position with the lid support wall resting on a support surface and said bottom wall of said receptacle facing upwardly and being removable from said receptacle following reorientation of the container into a final position thereof in which said receptacle is situated on top of said base which is then in its fully erected condition, said lid having a plurality of lid skirt walls surrounding and extending perpendicularly away from said lid support wall; and e) said cover skirt walls completely exteriorly overlapping said receptacle walls and said lid skirt walls to form an outer shipping box when said cover is assembled on said lid.

2. The convertible shipping container as defined in claim 1, wherein said base includes at least two sections that are hinged to one another for folding on top of one another adjacent to said bottom wall of said receptacle in said collapsed condition of said base, and to form substantially aligned extensions of one another in said erected condition of said base.

3. The convertible shipping container as defined in claim 1, and further comprising a protective panel situated in a shipping position thereof at said open end of said receptacle between said lid and the objects contained in said receptacle.

4. The convertible shipping container as defined in claim 3, wherein said protective panel is hinged to said receptacle for movement from said shipping position thereof into another position in which it reveals the objects contained in said receptacle.

5. The convertible shipping container as defined in claim 4, wherein said protective panel has two major surfaces at least one of which faces the passerby in said other position of said protective panel, at least said one major surface carrying informational matter relating to the objects on display.

6. The convertible shipping container as defined in claim 1, wherein said plurality of base walls constituting said base include a front wall, a back wall and two side walls, all as considered in said final position of the container, each of said side walls interconnecting said front wall with said back wall and including two substantially identical parts hinged to one another at a crease line for folding of said side wall parts on top of one another and as substantially aligned continuations of said front and back walls, respectively, in said collapsed condition of said base.

7. The convertible shipping container as defined in claim 6, and further comprising means for urging said plurality of base walls constituting said base toward said erected positions thereof.

8. The convertible shipping container as defined in claim 7, wherein said urging means includes at least one resilient element connected to said side walls of said base and pulling the same toward one another with a force that diminishes as said base approaches said erected condition thereof.

* * * * *